United States Patent [19]

Hirschle

[11] Patent Number: 4,784,219

[45] Date of Patent: Nov. 15, 1988

[54] HEAT EXCHANGER

[75] Inventor: Georg Hirschle, Wiesendangen, Switzerland

[73] Assignee: Sulzer Brothers Limited, Winterthur, Switzerland

[21] Appl. No.: 766,029

[22] Filed: Aug. 15, 1985

[30] Foreign Application Priority Data

Aug. 15, 1984 [CH] Switzerland ..... 3912/84-3

[51] Int. Cl.[4] ..... F28D 7/00; F28F 9/22

[52] U.S. Cl. ..... 165/160; 165/162

[58] Field of Search ..... 165/162, 160

[56] References Cited

U.S. PATENT DOCUMENTS

| | | | |
|---|---|---|---|
| 2,469,487 | 5/1949 | Woodard et al. | 165/162 |
| 2,508,247 | 5/1950 | Giauqie | 165/162 X |
| 2,833,526 | 5/1958 | Atten et al. | 165/160 X |
| 3,286,767 | 11/1966 | Evans | 165/162 X |
| 3,871,444 | 3/1975 | Houser et al. | 165/160 |
| 4,267,020 | 5/1981 | Burack | 165/160 X |
| 4,494,484 | 1/1985 | Ruzek | 165/160 X |
| 4,552,211 | 11/1985 | Weber | 165/162 X |
| 4,588,024 | 5/1986 | Murray et al. | 165/160 X |

FOREIGN PATENT DOCUMENTS

| | | | |
|---|---|---|---|
| 2841188 | 4/1979 | Fed. Rep. of Germany | 165/160 |
| 810349 | 3/1959 | United Kingdom | 165/160 |

*Primary Examiner*—Ira S. Lazarus
*Assistant Examiner*—Peggy A. Neils
*Attorney, Agent, or Firm*—Kenyon & Kenyon

[57] ABSTRACT

The heat exchanger is constructed in various embodiments such that the crevice duct between the outermost coil of tubes and the jacket defining the crevice duct is maintained at a constant width during operation. In some embodiments, the outermost coil tubes is carried on the jacket to maintain a constant width of the crevice duct. In other embodiments, a separate set of cooling tubes in provided to maintain the jacket cool. In other embodiments, the amount of heat drawn off through the outermost coil of tubes is increased.

20 Claims, 4 Drawing Sheets

HEAT EXCHANGER

This invention relates to a heat exchanger. More particularly, this invention relates to a heat exchanger for cooling hot gases.

As is known, various types of heat exchangers have been known for cooling gases, for example gases from a high-temperature reactor. In one case, it has been known to construct a heat exchanger with a pressure vessel in which a cylindrical gas flue is disposed for conveying a hot gas from an inlet zone to an outlet zone. In addition, a tube bunch has been disposed in the gas flue for conveying a cooling medium therethrough in heat exchange relation with the flow of hot gas. This tube bunch has been constructed so as to have an outermost coil of tubes spaced from the gas flue in order to define an annular crevice duct which is dimensioned so that, at the working temperature, the average temperature of the gas issuing from the crevice duct is substantially equal to the average temperature of the gas issuing from the remainder of the tube bunch.

In one known heat exchanger of the above type, a hot gas, such as helium, is cooled by water circulating in the cooling tubes while the water evaporates. Generally, there are no particular difficulties with this type of heat exchanger at relatively low gas temperatures. However, at relatively high gas temperatures, for example, 900° C., and particularly if the gas flue is of a large diameter, for example, more than 3.5 meters, such as occurs, for example, in heat exchangers for cooling helium issuing from a high-temperature reactor, considerable losses occur as the gas flows through the crevice duct. The reason for these losses is in that the transition to the working temperature, the cylindrical gas flue undergoes greater radial heat expansion than the bunch of cooling tubes. Consequently, the cross-section of the crevice duct increases disproportionately so that an appreciable quantity of inadequately cooled gas flows through such duct. Also, because of unavoidable manufacturing tolerances in the heat exchanger, the gas in the crevice duct is distributed unsatisfactorily as considered over the duct circumference, with the result that hot strands of gas form in the outlet zone of the heat exchanger. Because of the high temperatures, heat exchange phenomena occur so intensively that considerable excess temperatures and the associated weakenings and thermal stressing and deformations can occur very rapidly. In some circumstances, crevice losses may therefore put in question the possibility of using the known heat exchanger for high temperatures.

Previous endeavours to solve the problem of crevice losses have been based on damming up the gas flow in the crevice duct, for instanct, by means of fillers, ribs placed transversely to the gas flow and extending into the tube bunch and similar steps. Unfortunately, action of this kind cannot be taken at high temperatures since excess temperatures occur near the crevice duct because of the accumulation of material. A thermodynamically very complex behaviour also results which is difficult to comprehend both by calculation and by experiment.

Accordingly, it is an object of the invention to eliminate crevice losses in heat exchangers for cooling high temperature gases.

It is another object of the invention to provide a heat exchanger which can be used for high gas temperatures and large diameters.

It is another object of the invention to provide a heat exchanger which is able to cool hot gases in a reliable, simple and economical manner while avoiding excess temperatures.

Briefly, the invention provides a heat exchanger which is comprised of a pressure vessel, a cylindrical gas flue in the pressure vessel for conveying a hot gas from an inlet zone to an outlet zone and a tube bunch within the gas flue for conveying a cooling medium therethrough in heat exchange relation with the flow of hot gas. The tube bunch is constructed with an outermost coil of tubes which is transverse to the gas flow and spaced from the gas flue in order to define an annular crevice duct of a dimension that, at the working temperature, the average temperature of the gas issuing from the crevice duct is substantially equal to the average temperature of the gas issuing from the remainder of the tube bunch.

In accordance with the invention, means are provided for maintaining the average heat flow watts per square meter through the outermost coil of tubes substantially equal to the average heat flow through the remaining tubes of the tube bunch. By maintaining the average heat flow through the wall of the cooling tubes identical throughout the tube bunch, crevice losses are obviated in a simple and reliable manner. Thus, overheating can no longer occur.

Since damming means are not provided for damming the gas flow through the crevice duct, the behaviour of the heat exchanger can be understood very satisfactorily by calculation.

The means for maintaining the average heat flow through the outermost coil substantially equal to the average heat flow through the remaining coils may be constructed to inhibit (or prevent) an increase in the crevice duct width in response to increasing gas temperatures. This provides a direct action on the cause of crevice losses in order to prevent the losses from arising. In one embodiment, the means resides in having the gas flue made of a material having a lower coefficient of heat expansion than the material of the tube bunch. In another embodiment, the gas flue has at least one slot extending approximately along a generatrix at least near the gas inlet side of the tube bunch in order to permit heating of the gas flue while maintaining the diameter of the gas flue. In this embodiment, clamping means may be provided about the slot of the gas flue in order to restrain heat expansion of the gas flue.

In still another embodiment, the outermost coil of tubes may be rigidly secured to the gas flue so as to expand therewith under thermal conditions.

In still another embodiment, the means for maintaining the average heat flow through the outermost coil tubes equal to the average heat flow through the remainder of the tubes may be in the form of a plurality of tubes which are disposed on the inside of the gas flue for conveying a cooling medium therethrough independently of the cooling medium conveyed through the tube bunch. These tubes may be disposed helically along the inside of the gas flue in order to substantially complete adaptation of the flow and thermodynamic conditions in the crevice duct to those in the tube bunch.

In still another embodiment, at least one of the gas flue and the outermost coil of tubes may be roughened adjacent the crevice duct. Alternatively, a labyrinth seal may be provided on the inside of the gas flue in order to restrict the flow of gas in the crevice duct. In either case, by increasing gas pressure losses, the quantity of gas flowing through the crevice duct is reduced. Further, the resulting turbulence improves heat transfer and temperature distribution near the crevice duct. The use of roughened surfaces is preferred for a narrow crevice while the use of a labyrinth seal is preferred for a relatively large crevice. Further, this latter embodiment may be used to produce flows across the longitudinal axis of the gas flue in the crevice duct.

In another embodiment, the gas flue is shaped to form a plurality of undulations. This embodiment has similar effects as the latter two embodiments but has manufacturing advantages.

In still another embodiment, the surface of the outermost coil of tubes is greater than each of the remaining coils of tubes of the tube bunch. In this case, the greater surface area aids in the removal of additional heat from the crevice duct without any increase in heat flow density through the walls of the outermost coil of tubes.

In still another embodiment, a plurality of deflecting plates are disposed within the tube bunch for guiding the gas from the tube bunch to the crevice duct. In this embodiment, the heat from the crevice duct is distributed to at least some of the other coils of the tube bunch so that the heat flow in the tube bunch is equalized and overheating prevented.

These and other objects and advantages of the invention will become more apparent from the following detailed description taken in conjunction with the accompanying drawings wherein:

FIG. 1 diagrammatically illustrates a longitudinal sectional view through a known vertical heat exchanger for cooling helium from a high-temperature reactor;

Figure 1:
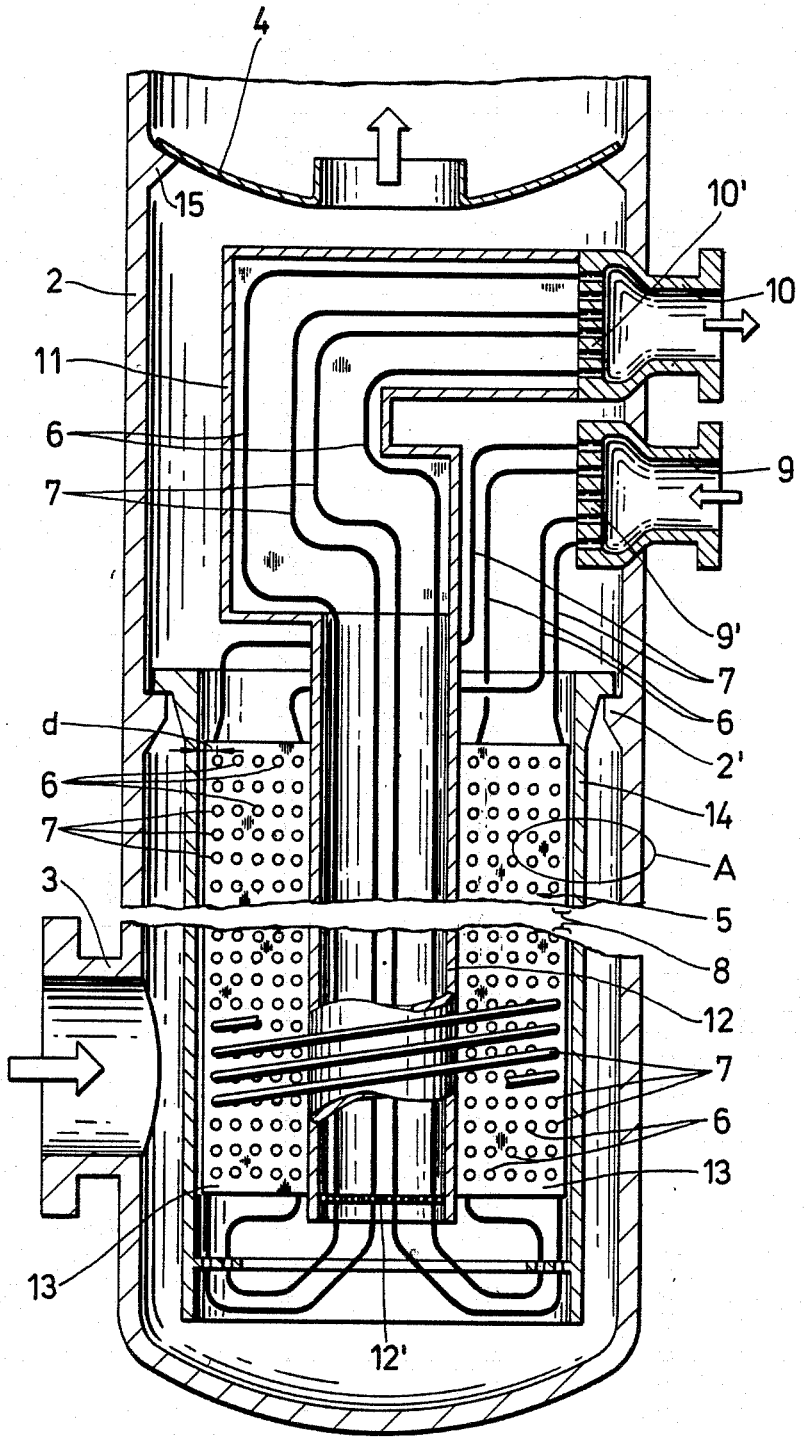

Referring to FIG. 1, the heat exchanger is constructed in known fashion with a cylindrical pressure vessel 2 which is closed by a bottom outwardly convex base and which is provided with a gas inlet connection 3 near the bottom end of the vessel 2. As indicated, the gas inlet connection 3 is able to receive a flow of hot gas, such as hot helium gas supplied from a high-temperature reactor (not shown). The pressure vessel 2 also has a downwardly convex gas outlet cover 4 at the top which is carried on an edge 15 which projects into the interior of the vessel 2 and is secured thereto by screws (not shown). As indicated, the cover 4 is formed with a central aperture which forms a gas outlet for expelling the flow of gas.

In addition, a tube bunch 5 is disposed in the bottom part of the pressure vessle 2, for example being constructed of approximately five hundred cooling tubes for water and steam. Over most of their length, the tubes of the tube bunch 5 are in the shape of helices. The outermost coil of tubes is designated with the reference character 7 while the remaining tubes of the bunch 5 are designated with the reference character 6.

The pressure vessel 2 has a water inlet connection 9 and a steam outlet connection 10 below the cover 4. Each connection 9, 10 widens in the vessel 2 and terminates in a vertical tube plate 9', 10' formed with horizontal bores. The inside of the vessel 2 is provided with a substantially C-shaped tube box 11 which is secured to the steam outlet connection 10 as well as to a central tube 12 which extends coaxially of the vessel 2 and to below the gas inlet connection 3.

The cooling tubes 6, 7 have one of their ends connected to the plate 9' and the other of their ends connected to the plate 10'. Starting from the plate 9', the tubes are first distributed uniformly around the central tube 12, then merge into a helical shape concentrically of the tube 12. Below the gas inlet connection 3, the tubes are bent round towards the central tube 12 and extend through a horizontal closure plate 12' received sealingly in the bottom of the central tube 12. The cooling tubes 6, 7, which are welded in sealingly at the closure plate 12', then extend vertically upwards in the central tube 12 and extend in the box 11 substantially in a C-shape to the tube plate 10'. In their helical parts, the cooling tubes 6, 7 are screwed into eight support plates 13 which are distributed uniformly over the periphery of the bunch 5 and which are secured to the central tube 12.

A cylindrical jacket 14 which is coaxial of the vessel 2 and which extends around the bunch 5 is carried on an inner horizontal flange 2' of the pressure vessel 2, the flange 2' being disposed below the water inlet connection 9. The jacket 14 forms a cylindrical gas flue for the hot gas flowing from the inlet connection 3 to the outlet in the cover 4 and extends to below the cooling tubes 6, 7. The inside of the jacket 14 and a theoretical vertical cylinder on which the axes of the helical outer tubes 7 lie bound an annular crevice duct 8 of crevice width d. An inner flange 14' near the bottom end of the jacket 14 guides that part of the tubes 6, 7 which is disposed between the plates 13 and the closure plate 12'. A number of perforate plates (not shown) are disposed in the central tube 12 and box 11 which support the tubes 6, 7 laterally.

The heat exchanger shown in FIG. 1 operates as follows:

Hot helium at a temperature of approximately 700° C. and a pressure of approximately 65 bar flows through the gas inlet connection 3 into the pressure vessel 2 and is distributed in the annular chamber between the vessel 2 and the jacket 14. The helium descends in the chamber, then flows upwardly through the tube bunch 5 inside the jacket 14 and leaves the heat exchanger, still at a pressure of approximately 65 bar but at a temperature of only 280° C., through the central aperture in the cover 4. Water for cooling the helium gas is supplied at a temperature of approximately 200° C. through the water inlet connection 9 to the cooling tubes 6, 7, flows through the helical parts thereof, evaporating in doing so, and issues from the steam outlet connection 10 as steam at a temperature of approximately 530° C. and a pressure of approximately 185 bar.

As the temperature of the helium rises to the working temperature, the width d of the duct 8 increases due to heat expansion of the jacket 14 and tube bunch 5 and, as previously described, the quantity of helium gas flowing through the duct 8 increases disproportionately more than the duct width d. For instance, an increase in the width d of 5 millimeters (mm) may lead to an approximately 30% increase in the effective quantity of gas flowing through the duct 8. The temperature of the helium gas in the duct 8 increases correspondingly since the quantity of heat carried along by the increase throughflow of gas cannot readily be removed by the outer tubes 7. On the assumption of the 5 millimeter (mm) increase in the width d, the temperature will increase by more than 20° C.

Also, because of unavoidable manufacturing tolerances in the shape and dimension of the gas flow, an irregular distribution of mass flow and temperature may arise in the duct 8, in which event the hot gas strands previously referred to may arise.

Figure 2:
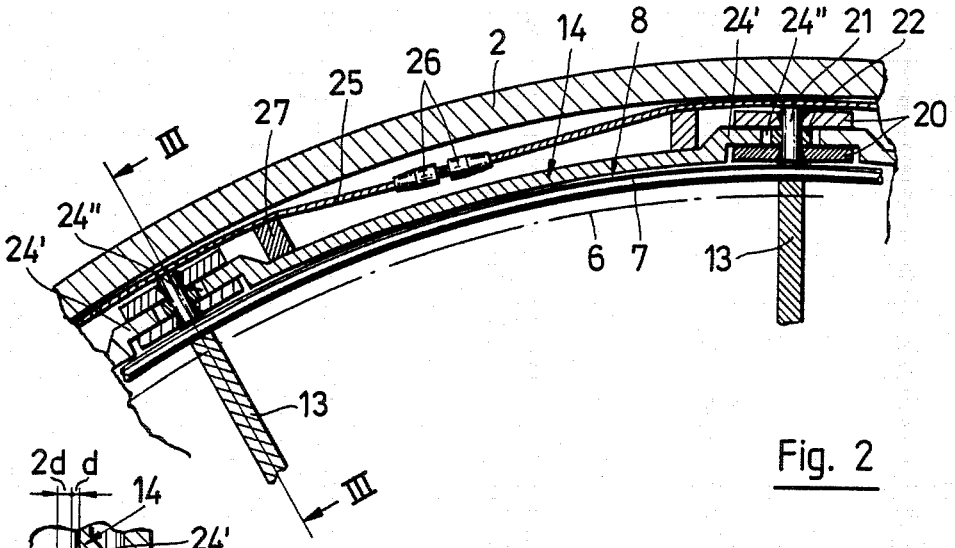
FIG. 2 illustrates a plan view of the detail A of FIG. 1 in a heat exchanger according to the invention, the view being to a larger scale than in FIG. 1.
Figure 3:
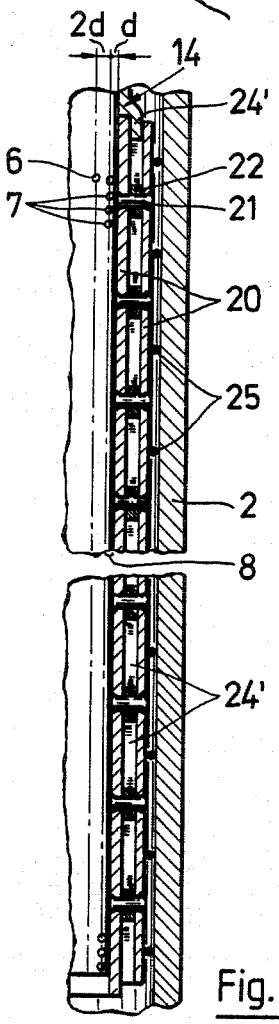
FIG. 3 illustrates a view taken on line III—III of FIG. 2 but to a smaller scale than FIG. 2.

Referring to FIGS. 2 and 3 in order to inhibit crevice losses, a means is provided for maintaining the average heat flow through the outermost coil of the tubes substantially equal to the average heat flow through the remaining tubes of the tube bunch. To this end, the jacket 14 is formed with eight vertical slots which are distributed over the circumference of the jacket 14, two such slots being shown in FIG. 2. The jacket also has an outward set 24' near each slot which is parallel to the slot. The two end faces 24'' of the resulting sets 24' bound each slot. In addition, a pair of metal strips 20 are disposed over the outward sets 24' in order to slidingly guide each. Each pair of metal strips 20 are held together by pins 21 which extend radially through a slot and which are secured, as by welding to the strips 20. A spacing sleeve 22 extends around each pin 21 and determines the spacing between any two strips 20. A material having good sliding properties is also provided on the surfaces of the sets 24' which slide on the strips 20.

Clamping means in the form of cables 25 extend around the jacket 14 and are uniformly distributed over the vertical length of the slots. The cables 25 bear on the jacket 14 via the interposition of block 27 and have their ends interconnected by turnbuckles 26. The cables 25 are made of a material having a lower tangential heat expansion than that of the jacket 14. Consequently, as the temperature of the helium gas increases, the sets 24' slide between the strips 20 in pairs tangentially to one another. However, the diameter of the jacket 14 remains substantially the same so that the crevice width d decreases because of the radial heat expansion of the tube bunch 5. As a result, the quantity of gas flowing through the crevice duct 8 is kept at a satisfactorily low level and the risk of overheating is reduced. Theoretically, the cables 25 are not required; however, the cables 25 provide additional security against possible jamming, for example, because of dirt, of the sets 24' between the strips 20.

Figure 4:
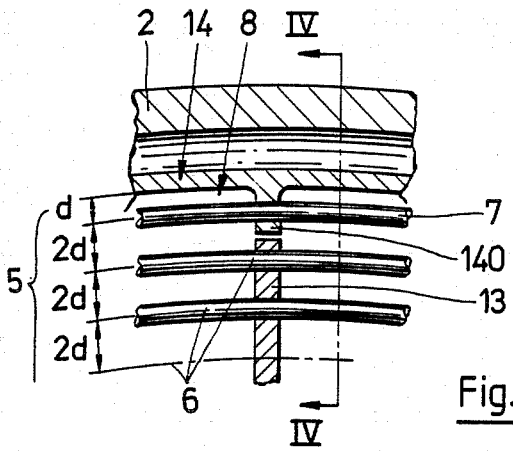
FIG. 4 illustrates a plan view of the detail A of FIG. 1 in another embodiment of the invention, the view being to an enlarged scale.
Figure 5:
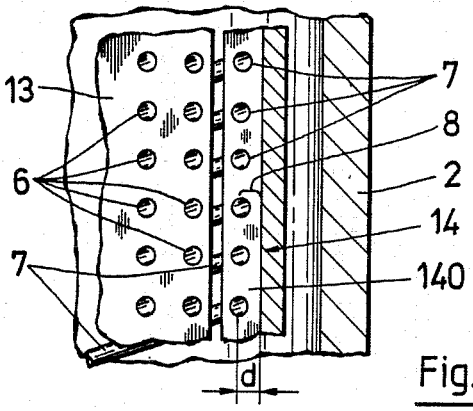
FIG. 5 illustrates a view taken on line IV—IV of FIG. 4.

Referring to FIGS. 4 and 5, wherein like reference characters indicate like parts as above, the support plates 13 are made of smaller radial extent so as to receive only the inner cooling tubes 6 of the tube bunch 5. The outermost coil of tubes 7 are screwed into eight radial webs 140 which are integral with the jacket 14 with each aligned with a respective plate 13. Alternatively, the webs 140 may be in the form of strips of which are welded to the jacket 14. In this embodiment, as the temperature rises, the outer tubes 7 move with jacket 14 as the diameter of the jacket 14 increases. Hence, the width d of the crevice duct remains substantially constant at all temperatures disregarding minor radial heat expansion of the tubes themselves and the linear heat expansion of the webs 140. The webs 140 thus not only secure the outermost coil of tubes 7 to the jacket 14, but also maintains the average heat flow density through the outermost coil of tubes 7 substantially equal to the average heat flow density through the remaining tubes 6 of the tube bunch 5.

Figure 6:
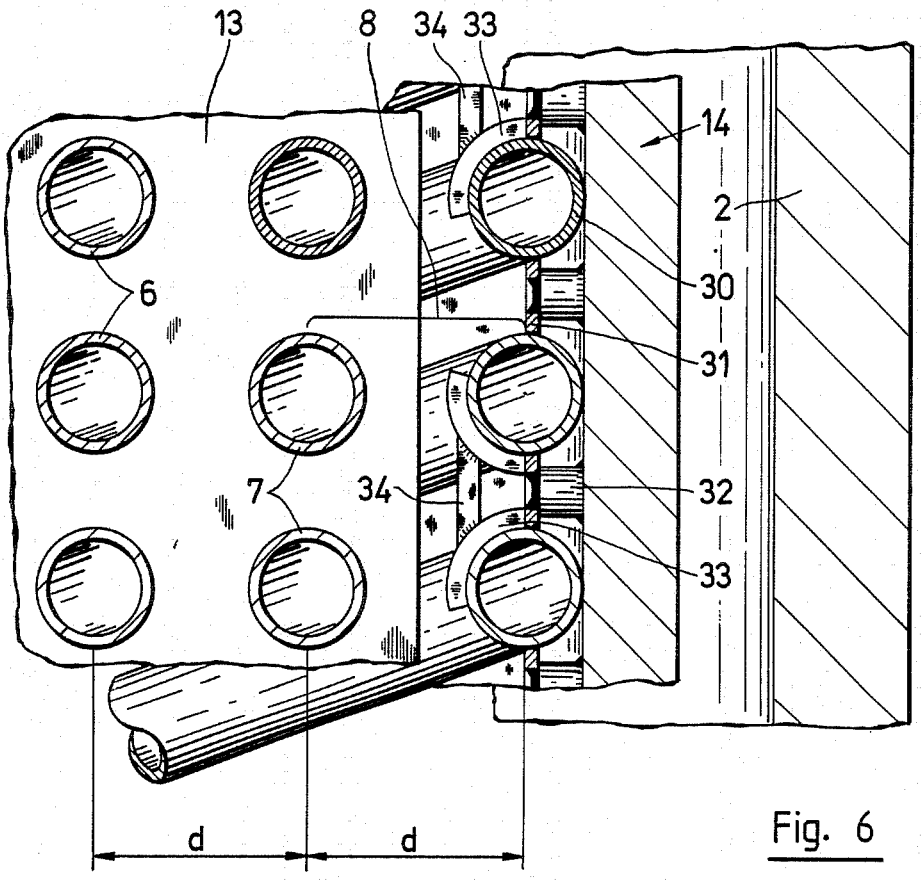
FIG. 6 illustrates a vertical section of the detail A in FIG. 1 in another embodiment of the invention, the view being to an enlarged scale.

Referring to FIG. 6, wherein like reference characters indicate like parts as above, the means for maintaining the average heat flow through the outermost coil of tubes 7 substantially equal to the average heat flow through the remaining tubes 6 may employ a plurality of tubes 30 on the inside of the jacket 14 for conveying a cooling medium therethrough independently of the cooling medium passing through the coils of tubes 6, 7 of the bunch 5. As indicated, the tubes 30 are helically wound and are of the same diameter and the same pitch as the tubes 6, 7. The horizontal distance between the tubes 30 and the outer tubes 7 is approximately equal to the horizontal distance between the adjacent tubes 6 and 7 in the tube bunch 5.

The tubes 30 are secured to the inside wall of the jacket 14 via helical metal strips 31 provided between the tubes 30 and pins 32 which are secured to the strips 31 and jacket 14 as by welding. As indicated, the strips 31 have weld bores for connection of the pins 32 and strips 31.

In addition, pairs of substantially quadrant-shaped clips 33 of steel plate are welded to some strips 31 to engage a tube 30. These clips 33 serve to retain the tubes 30 in place. Each pair of clips 33 is located by an interconnecting reinforcing plate 34.

The strips 31 bound a cylinder surface on which the helically extending axis of the tubes 30 lies and which serves to dimension the crevice duct 8 width d which, in this case, is equal to the horizontal distance d between the adjacent tubes 6 and 7.

The embodiment of FIG. 6 is advantageous particularly at very high working temperatures since the tubes 30 are secured in a simple and economical manner to the jacket 14 without the use of a weld seam. The quantity of cooling water flowing through the tubes 30 is so adjusted by means of restrictors (not shown) that the cooling of the helium gas in the duct 8 is equal to the cooling in the tube bunch 5. Another advantage of this embodiment is that the gas-side flow conditions in the duct 8 can be substantially adapted to the gas-side flow conditios in the tube bunch 5.

Figures 7, 8, 9, 10, 11, 12:
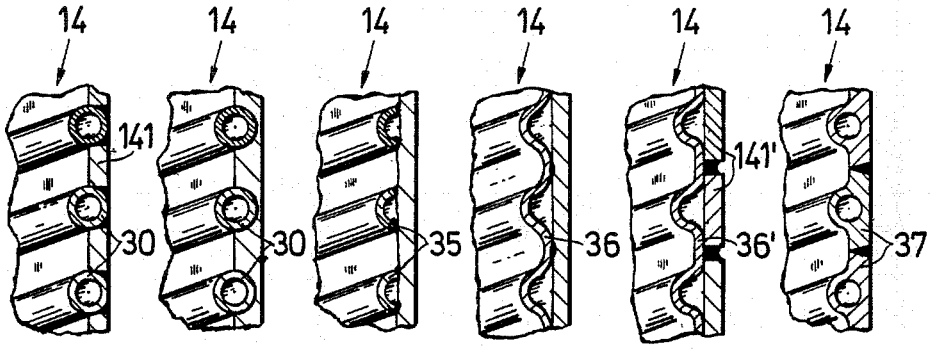
FIG. 7 illustrates a partial cross sectional view of a further embodiment for cooling the gas flue in accordance with the invention.
FIG. 8 illustrates a partial cross section view of a further modification for cooling the gas flue in accordance with the invention.
FIG. 9 illustrates a further embodiment using half tubes for cooling a gas flue in accordance with the invention.
FIG. 10 illustrates a partial cross sectional view of a further embodiment utilizing a corrugated plate for cooling the gas flue in accordance with the invention.
FIG. 11 illustrates a further modification similar to FIG. 10 in accordance with the invention.
FIG. 12 illustrates a further embodiment for cooling a gas flue in accordance with the invention.

Referring to FIGS. 7 to 12, the means for maintaining the average heat flow through the outermost coil of tubes of the tube bunch may be constructed to convey a cooling medium in heat exchange relation with the jacket 14. In one embodiment, as shown in FIG. 7, a plurality of tubes 30 may be welded together in gas tight manner by means of webs 141 so as to form the jacket 14, for example, in the form of a diaphragm wall. Alternatively, as shown in FIG. 8, the tubes 30 may be embedded in a helical groove in the jacket 14.

Referring to FIG. 9, half-tubes 35 may be welded in seal tight manner to a smooth cylindrical inside of the jacket 14 so as to convey cooling water in a helical duct. Alternatively, a corrugated plate 36, as shown in FIG. 10, may be used in place of the half-tubes 35. Also, as shown in FIG. 11, a corrugated plate 36' may be welded to webs 141' in order to form the jacket 14.

Referring to FIG. 12, the jacket 14 may be formed of welded-together helically extending tubes 37 which are integral with fins which, on one side, are disposed outside the tube axis.

Figure 13:
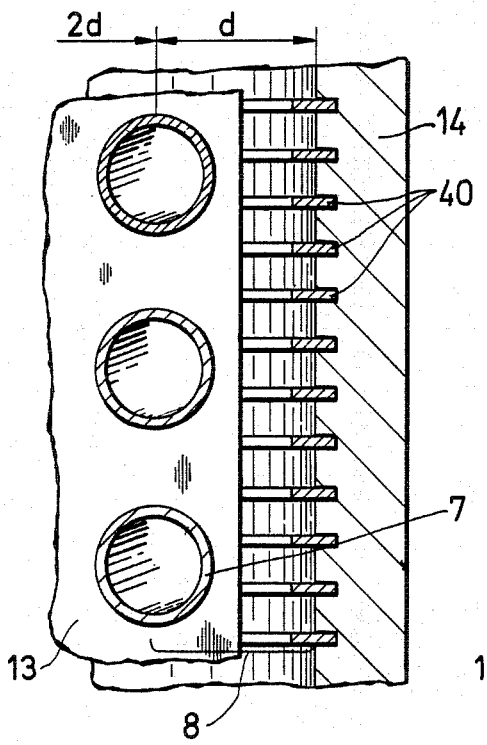
FIG. 13 illustrates a further embodiment employing a labyrinth seal between a gas flue and an outermost coil of tubes in accordance with the invention.

Referring to FIG. 13, in order to retain equalized flow conditions, a plurality of horizontal flat steel rings 40 similar to piston rings are clamped in fitting grooves in the inside of the jacket 14 in order to define an undulating flow path for the gas through the crevice duct 8. In this respect, the rings 40 restrict the flow of helium gas in the crevice duct 8 and also produce an intense eddying. Consequently, the through flow of the gas is reduced and the cooling in the duct 8 is improved.

Figure 14:
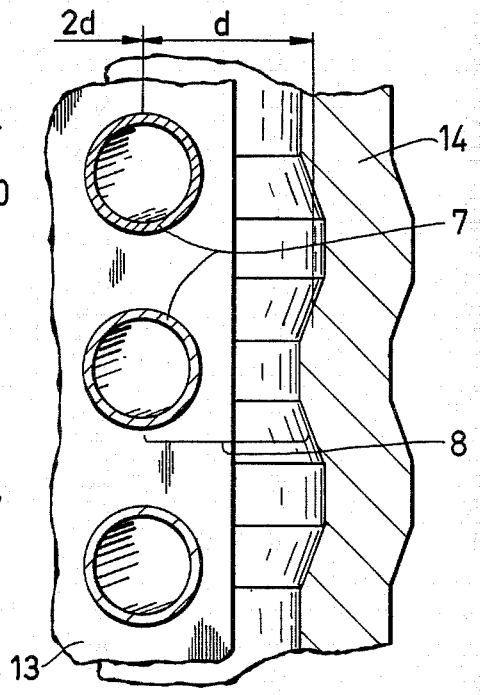
FIG. 14 illustrates the use of an undulating gas flue wall in accordance with the invention.

Referring to FIG. 14, the jacket 14 may be constructed so that the duct 8 has a crevice width which is variable vertically. As indicated, relatively narrow crevice cross-sections may alternate with relatively wide crevice cross-sections. An effect similar to that provided by the rings 40 of FIG. 13 is therefore provided. This embodiment is substantially insensible by variations in crevice width due to manufacturing tolerances. Of note, the jacket 14 may be shaped in other fashions to form a plurality of undulations in order to effect retension of the equalized flow conditions.

Figure 15:
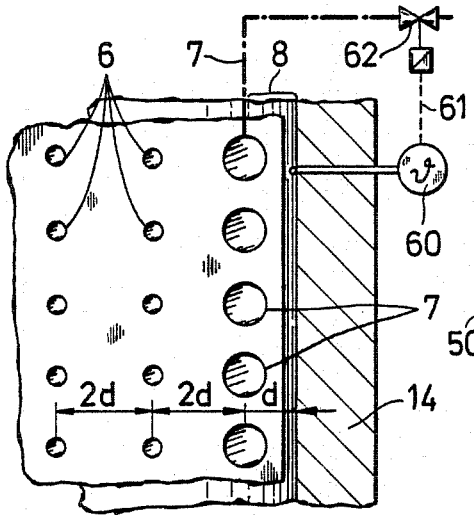
FIG. 15 illustrates a further modification according to the invention employing an independent supply of cooling medium for the outermost coil of tubes.

Referrin to FIG. 15, wherein like reference characters indicate like parts as above, the outermost coil of tubes 7 may be provided with a greater surface than each of the remaining coils of tubes 6 while having the same wall thickness. Consequently, when the crevice width increases at the working temperature, the outer tube 7 can remove more heat from the correspondingly increased quantity of gas flowing through the duct 8 without the heat flow density through their walls exceeding the heat flow through the walls of the other tubes 6.

A temperature sensor 60 which senses the temperature of the helium gas in the duct 8 may be used to control a control valve 62, one of which is provided for each outer cooling tube 7, via a signal line 61.

The control of the control valve 62 is such that the quantity of cooling water flowing through the outer tube 7 is such that the average temperature of the helium gas in the duct 8 is equal to the average temperature of the helium gas near the tubes 6 of the tube bunch 5 and so that the average heat flow density through the wall of the tubes 6 is maintained equal to the average heat flow through the outer tubes 7.

Figure 16:
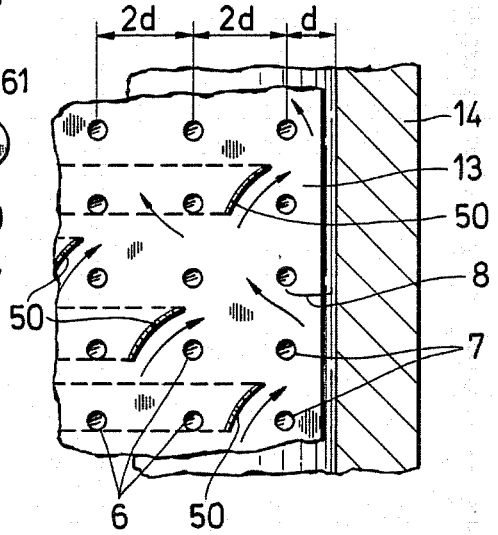
FIG. 16 illustrates an embodiment employing deflecting plates in accordance with the invention.

Referring to FIG. 16, a plurality of annular deflecting plates 50 of different diameters are so disposed in staggered fashion within the tube bunch 5 for guiding the helium gas from within the tube bunch 5 to the crevice duct 8. These plates 50 also enable helium gas to be displaced from the duct 8 back into the tube bunch 5. The resulting flow pattern is such that a temperature equalization of the gas in the duct 8 occurs with the remainder of the tube bunch 5.

The deflecting plates 50 are connected to the plates 13 so that the heat received by the plates 50 flows through the plates 13 to the tubes 6, 7 thus ensuring that the plates 50 are cooled.

In further embodiments, the outermost cooling tubes 7 can be arranged with a greater pitch than the remaining cooling tubes 6. In this case, in every vertical plane, cooler cooling water is available near the duct 8 than elsewhere in the tube bunch 5. If this feature is combined, for example, with the feature shown in FIG. 15 or FIG. 16, the coarser pitch of the outer tube 7 enables relatively large quantities of heat to be removed from the duct 8 without overheating of the gas flue.

In still other embodiments, at least one of the gas flue and the outermost coil of tubes may be roughened adjacent the crevice duct.

The heat exchanger may be constructed with straight or meandering cooling tubes. Further, the cylindrical gas flue may be disposed horizontally or at any inclination.

Of note, the control of the temperature in the crevice duct 8 as indicated in FIG. 15 may be used in all of the described embodiments.

The invention thus provides a heat exchanger which can be used for cooling high temperature gases while eliminating crevice losses.

Further, the invention provides a relatively simple means for maintaining the average heat flow through the outermost coil of tubes substantially equal to the average heat flow through the remaining tubes of a tube bunch of a heat exchanger.

What is claimed is:

1. A heat exchanger comprising a pressure vessel;

a cylindrical gas flue in said pressure vessel for conveying a hot gas from an inlet zone to an outlet zone;

a tube bunch within said gas flue for conveying a cooling medium therethrough in heat exchange relation with the flow of hot gas, said tube bunch having an outermost coil of tubes transverse to the gas flow and spaced from said gas flue to define an annular crevice duct of a dimension that, at the working temperature, the average temperature of the gas issuing from said crevice duct is substantially equal to the average temperature of the gas issuing from the remainder of said tube bunch; and means for maintaining the average heat flow through said outermost coil of tubes substantially equal to the average heat flow through the remaining tubes of said tube bunch during heating and radial expansion of said flue.

2. A heat exchanger as set forth in claim 1 wherein said means prevents an increase in crevice duct width in response to increasing gas temperatures.

3. A heat exchanger as set forth in claim 2 wherein said gas flue is made of a material having a lower coefficient of heat expansion than the material of said tube bunch.

4. A heat exchanger as set forth in claim 1 wherein said means includes at least one slot in said gas flue extending approximately along a generatrix at least near the gas inlet side of said tube bunch and at least one metal strip disposed along and over said slot to slidingly guide said gas flue during heat expansion to permit heating of said gas flue while maintaining the diameter of said gas flue.

5. A heat exchanger as set forth in claim 4 which further comprises clamping means about said slot of said gas flue for restraining heat expansion of said gas flue.

6. A heat exchanger as set forth in claim 2 wherein said outermost coil of tubes is secured to said gas flue.

7. A heat exchanger as set forth in claim 1 wherein said means includes a plurality of tubes disposed on an inside of said gas flue for conveying a cooling medium therethrough.

8. A heat exchanger as set forth in claim 1 wherein at least one of said gas flue and said outermost coil of tubes is roughened adjacent said crevice duct.

9. A heat exchanger as set forth in claim 1 wherein said means forms a labyrinth seal on the inside of said gas flue to restrict the flow of gas in said crevice duct.

10. A heat exchanger as set forth in claim 1 wherein said gas flue is shaped to form a plurality of undulations and said undulations form said means.

11. A heat exchanger as set forth in claim 1 wherein said outermost coil of tubes has a greater surface than each of the remaining coils of tubes of said tube bunch to form said means.

12. A heat exchanger as set forth in claim 1 wherein said means includes a plurality of deflecting plates within said tube bunch for guiding the gas from said tube bunch to said crevice duct.

13. A heat exchanger as set forth in claim 1 wherein said tube bunch includes helically extending tubes.

14. A heat exchanger as set forth in claim 13 wherein said means includes a helical duct secured to an inside of said gas flue for conveying a cooling medium therethrough to cool said gas flue.

15. A heat exchanger for cooling hot gases comprising a pressure vessel having a gas inlet connection for receiving a flow of hot gas and a gas outlet for expelling the flow of gas;

a cylindrical jacket disposed within said pressure vessel to form a gas flue therein for the passage of the flow of hot gas from said inlet connection to said gas outlet;

a tube bunch coiled within said jacket for conveying a cooling medium therethrough in heat exchange relation with the flow of hot gas, said tube bunch having an outermost coil of tubes transverse to the gas flow and bounding an annular crevice duct of predetermined width with said jacket; and means for maintaining the average heat flow through said outermost coil of tubes substantially equal to the average heat flow through the remaining tubes of said tube bunch during heating and radial expansion of said jacket.

16. A heat exchanger as set forth in claim 15 wherein said means secures said outermost coil to said gas flue to maintain said width of said crevice duct constant at all operating temperatures.

17. A heat exchanger as set forth in claim 15 wherein said means conveys a cooling medium in heat exchange relation with said jacket.

18. A heat exchanger as set forth in claim 15 wherein said means is connected to said outermost coil to control the quantity of cooling medium passing therethrough.

19. A heat exchanger as set forth in claim 15 wherein said means defines an undulating flow path for the gas through said crevice duct.

20. A heat exchanger for cooling a hot gas comprising a pressure vessel having a gas inlet connection for receiving a flow of hot gas and a gas outlet for expelling the flow of gas;

a cylindrical jacket disposed within said pressure vessel to form a gas flue therein for passage of the flow of hot gas from said inlet connection to said gas outlet, said jacket having at least one slot extending longitudinally of said gas flue to permit heat expansion of said jacket while maintaining the diameter of said jacket; and a tube bunch within said gas flue for conveying a cooling medium therethrough in heat exchange relation with the flow of hot gas, said tube bunch having an outermost coil of tubes transverse to the gas flow and spaced from said gas flue to define an annular crevice duct of a dimension that, at the working temperature, the average temperature of the gas issuing from said crevice duct is substantially equal to the average temperature of the gas issuing from the remainder of said tube bunch.

* * * * *

UNITED STATES PATENT AND TRADEMARK OFFICE

CERTIFICATE OF CORRECTION

PATENT NO. : 4,784,219

DATED : Nov. 15, 1988

INVENTOR(S) : GEORG HIRSCHLE

It is certified that error appears in the above-identified patent and that said Letters Patent is hereby corrected as shown below:

In the Abstract, line 5 "coil tubes" should be -coil of tubes-
In the Abstract, line 8 "in" should be -is-
Column 1, line 34 "in that" should be -that in-
Column 1, line 54 "instanct" should be -instance-
Column 4, line 21 "vessle" should be -vessel-
Column 5, line 31 "increase" should be -increased-
Column 5, line 63 "block" should be -blocks-
Column 6, line 18 cancel "of" (second occurrence)
Column 6, line 27 "maintains" should be -maintain-
Column 6, line 58 "dimension" should be -define-
Column 7, line 3 "conditios" should be -conditions-
Column 7, line 41 "by" should be -to- Signed and Sealed this Nineteenth Day of September, 1989

*Attest:*

*Attesting Officer*

DONALD J. QUIGG

*Commissioner of Patents and Trademarks*